US009883311B2

(12) United States Patent
Breebaart et al.

(10) Patent No.: US 9,883,311 B2
(45) Date of Patent: Jan. 30, 2018

(54) RENDERING OF AUDIO OBJECTS USING DISCONTINUOUS RENDERING-MATRIX UPDATES

(71) Applicant: DOLBY LABORATORIES LICENSING CORPORATION, San Francisco, CA (US)

(72) Inventors: Dirk Jeroen Breebaart, Pyrmont (AU); David S. McGrath, Rose Bay (AU); Rhonda Wilson, San Francisco, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 38 days.

(21) Appl. No.: 14/898,737

(22) PCT Filed: Jun. 23, 2014

(86) PCT No.: PCT/US2014/043700

§ 371 (c)(1),
(2) Date: Dec. 15, 2015

(87) PCT Pub. No.: WO2014/209902

PCT Pub. Date: Dec. 31, 2014

(65) Prior Publication Data

US 2016/0142844 A1 May 19, 2016

Related U.S. Application Data

(60) Provisional application No. 61/840,591, filed on Jun. 28, 2013.

(51) Int. Cl.
*H04S 3/02* (2006.01)
*G10L 19/008* (2013.01)
(Continued)

(52) U.S. Cl.
CPC ..... *H04S 3/02* (2013.01); *G10L 19/008* (2013.01); *G10L 19/032* (2013.01); *H04S 7/30* (2013.01); *H04S 2400/11* (2013.01)

(58) Field of Classification Search
CPC ..... G10L 19/008; G10L 19/20; G10L 19/173; H04S 2400/03; H04S 3/02; H04S 2420/01
(Continued)

(56) References Cited

U.S. PATENT DOCUMENTS 6,353,703 B1 3/2002 Tatsumi
7,336,793 B2 2/2008 Horbach
(Continued)

FOREIGN PATENT DOCUMENTS

RS 1332 U 8/2013
WO 2013/006338 1/2013

OTHER PUBLICATIONS

Stanojevic, T. "Some Technical Possibilities of Using the Total Surround Sound Concept in the Motion Picture Technology", 133rd SMPTE Technical Conference and Equipment Exhibit, Los Angeles Convention Center, Los Angeles, California, Oct. 26-29, 1991.
(Continued)

*Primary Examiner* — George Monikang

(57) ABSTRACT

An audio playback system generates output signals for multiple channels of acoustic transducers by applying a rendering matrix to data representing the aural content and spatial characteristics of audio objects, so that the resulting sound field creates accurate listener impressions of the spatial characteristics. Matrix coefficients are updated to render moving objects. Discontinuous updates of the rendering matrix coefficients are controlled according to psychoacoustic principles to reduce audible artifacts. The
(Continued)

updates may also be managed to control the amount of data needed to perform the updates.

20 Claims, 3 Drawing Sheets

(51) Int. Cl.

| | |
|---|---|
| ***H04S 5/02*** | (2006.01) |
| ***H04S 3/00*** | (2006.01) |
| ***H04S 7/00*** | (2006.01) |
| ***G10L 19/032*** | (2013.01) |

(58) Field of Classification Search
USPC ..... 381/22, 23, 17–19
See application file for complete search history.

(56) References Cited

U.S. PATENT DOCUMENTS

| | | | | |
|---|---|---|---|---|
| 7,391,875 | B2 | 6/2008 | Shashoua | |
| 7,756,281 | B2 | 7/2010 | Goldstein | |
| 8,090,586 | B2 | 1/2012 | Oh | |
| 8,271,289 | B2 | 9/2012 | Kim | |
| 2002/0021811 | A1 | 2/2002 | Kubota | |
| 2002/0118844 | A1* | 8/2002 | Welsh | G05B 5/01 381/94.3 |
| 2005/0281418 | A1 | 12/2005 | Shashoua | |
| 2010/0076774 | A1 | 3/2010 | Breebaart | |
| 2012/0143613 | A1 | 6/2012 | Herre | |
| 2012/0177204 | A1* | 7/2012 | Hellmuth | G10L 19/008 381/22 |
| 2012/0243690 | A1 | 9/2012 | Engdegart | |

OTHER PUBLICATIONS

Stanojevic, T. et al "Designing of TSS Halls" 13th International Congress on Acoustics, Yugoslavia, 1989.
Stanojevic, T. et al "The Total Surround Sound (TSS) Processor" SMPTE Journal, Nov. 1994.
Stanojevic, T. et al "The Total Surround Sound System", 86th AES Convention, Hamburg, Mar. 7-10, 1989.
Stanojevic, T. et al "TSS System and Live Performance Sound" 88th AES Convention, Montreux, Mar. 13-16, 1990.
Stanojevic, T. et al. "TSS Processor" 135th SMPTE Technical Conference, Oct. 29-Nov. 2, 1993, Los Angeles Convention Center, Los Angeles, California, Society of Motion Picture and Television Engineers.
Stanojevic, Tomislav "3-D Sound in Future HDTV Projection Systems" presented at the 132nd SMPTE Technical conference, Jacob K. Javits Convention Center, New York City, Oct. 13-17, 1990.
Stanojevic, Tomislav "Surround Sound for a New Generation of Theaters, Sound and Video Contractor" Dec. 20, 1995.
Stanojevic, Tomislav, "Virtual Sound Sources in the Total Surround Sound System" Proc. 137th SMPTE Technical Conference and World Media Expo, Sep. 6-9, 1995, New Orleans Convention Center, New Orleans, Louisiana.
Gerzon, M. et al "The MLP Lossless Compression System for PCM Audio" JAES vol. 52, Issue 3, pp. 243-260, Mar. 2004.
Todd, C. et al "AC-3: Flexible Perceptual Coding for Audio Transmission and Storage" AES 96th Convention, Feb. 1, 1994.
Andersen, R. et al "Introduction to Dolby Digital Plus, an Enhancement to the Dolby Digital Coding System" AES, presented at the 117th Convention, Oct. 28-31, 2004, San Francisco, CA, USA.
Bosi, M. et al "ISO/IEC MPEG-2 Advanced Audio Coding" AES 101st Convention, Nov. 8-11, 1996.
Bauer, Benjamin B. "Phasor Analysis of Some Stereophonic Phenomena" The Journal of the Acoustical Society of America, vol. 33, No. 11, Nov. 1961.
Bennett, J.C. et al "A New Approach to the Assessment of Stereophonic Sound System Performance", J. Audio Engineering Soc. pp. 314-321, 1985.
Moore, B.C.J. et al "A Model for the Prediction of Thresholds, Loudness, and Partial Loudness", J. Audio Eng. Soc. , pp. 224-240, Apr. 1997.
Heijden, Marcel Van Der, et al "Using an Excitation-Pattern Model to Predict Auditory Masking" vol. 80, Issue 1, Oct. 1994, pp. 38-52.

* cited by examiner

RENDERING OF AUDIO OBJECTS USING DISCONTINUOUS RENDERING-MATRIX UPDATES

CROSS REFERENCE TO RELATED APPLICATIONS

This application claims priority to U.S. Provisional Patent Application No. 61/840,591, filed on 28 Jun. 2013, which is hereby incorporated by reference in its entirety.

TECHNICAL FIELD

The present invention pertains generally to audio signal processing and pertains more specifically to processing of audio signals representing audio objects.

BACKGROUND ART

The Dolby® Atmos cinema system introduced a hybrid audio authoring, distribution and playback format for audio information that includes both "audio beds" and "audio objects." The term "audio beds" refers to conventional audio channels that are intended to be reproduced by acoustic transducers at predefined, fixed locations. The term "audio objects" refers to individual audio elements or sources of aural content that may exist for a limited duration in time and have spatial information or "spatial metadata" describing one or more spatial characteristics such as position, velocity and size of each object. The audio information representing beds and objects can be stored or transmitted separately and used by a spatial reproduction system to recreate the artistic intent of the audio information using a variety of configurations of acoustic transducers. The numbers and locations of the acoustic transducers may vary from one configuration to another.

Motion picture soundtracks that comply with Dolby Atmos cinema system specifications may have as many as 7, 9 or even 11 audio beds of audio information. Dolby Atmos cinema system soundtracks may also include audio information representing hundreds of individual audio objects, which are "rendered" by the soundtrack playback process to generate audio signals that are particularly suited for acoustic transducers in a specified configuration. The rendering process generates audio signals to drive a specified configuration of acoustic transducers so that the sound field generated by those acoustic transducers reproduces the intended spatial characteristics of the audio objects, thereby providing listeners with a spatially diverse and immersive audio experience.

The advent of object-based audio has significantly increased the amount of audio data needed to represent the aural content of a soundtrack and has significantly increased the complexity of the process needed to process and playback this data For example, cinematic soundtracks may comprise many sound elements corresponding to objects on and off the screen, dialog, noises, and sound effects that combine with background music and ambient effects to create the overall auditory experience. Accurate rendering requires that sounds be reproduced in a way that listener impressions correspond as closely as possible to sound source position, intensity, movement and depth for objects appearing on the screen as well as off the screen. Object-based audio represents a significant improvement over traditional channel-based audio systems that send audio content in the form of audio signals for individual acoustic transducers in predefined locations within a listening environment. These traditional channel-based systems are limited in the spatial impressions that they can create.

A soundtrack that contains a large number of audio objects imposes several challenges on the playback system. Each object requires a rendering process that determines how the object audio signal should be distributed among the available acoustic transducers. For example, in a so-called 5.1-channel reproduction system consisting of left-front, right-front, center, low-frequency effects, left-surround, right-surround channels, the sound of an audio object may be reproduced by any subset of these acoustic transducers. The rendering process determines which channels and acoustic transducers are used in response to the object's spatial metadata. Because the relative level or loudness of the sound reproduced by each acoustic transducer greatly influences the position perceived by listeners, the rendering process can perform its function by determining panning gains or relative levels for each acoustic transducer to create an aural impression of spatial position in listeners that closely resembles the intended audio object location as specified by its spatial metadata. If the sounds of multiple objects are to be reproduced over several acoustic transducers, the panning gains or relative levels determined by the rendering process can be represented by coefficients in a rendering matrix. These coefficients determine the gain for the aural content of each object for each acoustic transducer.

The value of the coefficients in a rendering matrix will vary in time to reproduce the aural effect of moving objects. The storage capacity and the bandwidth needed to store and convey the spatial metadata for all audio objects in a soundtrack may be kept within specified limits by controlling how often spatial metadata is changed, thereby controlling how often the values of the coefficients in a rendering matrix are changed. In typical implementations, the matrix coefficients are changed once in a period between 10 and 500 milliseconds in length, depending on a number factors including the speed of the object, the required positional accuracy, and the capacity available to store and transmit the spatial metadata.

When a playback system performs discontinuous rendering matrix updates, the demands for accurate spatial impressions may require some form of interpolation of either the spatial metadata or the updated values of the rendering matrix coefficients. Without interpolation, large changes in the rendering matrix coefficients may cause undesirable artifacts in the reproduced audio such as clicking sounds, zipper-like noises or objectionable jumps in spatial position.

The need for interpolation causes problems for existing or "legacy" systems that playback distribution media like the Blu-ray disc supporting lossless codecs such as those that conform to specifications for Meridian Lossless Packing (MLP). Additional details for MLP may be obtained from Gerzon et al., "The MLP Lossless Compression System for PCM Audio," J. AES, vol. 52, no. 3, pp. 243-260, March 2004.

An implementation of the MLP coding technique allows several user-specified options for encoding multiple presentations of the input audio. In one option, a medium can store up to 16 discrete audio channels. A reproduction of all 16 channels is referred to as a "top-level presentation." These 16 channels may be downmixed into any of several other presentations using a smaller number of channels by means of downmixing matrices whose coefficients are invariant during specified intervals of time. When used for legacy Blu-Ray streams, for example, up to three downmix presentations can be generated. These downmix presentations may have up to 8, 6 or 2 channels, respectively, which are often used for 7.1 channel, 5.1 channel and 2-channel stereo formats. The audio information needed for the top-level presentation is encoded/decoded losslessly by exploiting correlations between the various presentations. The downmix presentations are constructed from a cascade of matrices that give bit-for-bit reproducible downmixes and offer the benefit of requiring only 2-channel decoders to decode presentations for no more than two channels, requiring only 6-channel decoders to decode presentations for no more than six channels, and requiring 8-channel decoders to decode presentations for no more than eight channels.

For object-based content, however, this multi-level presentation approach is problematic. If the top-level presentation consists of objects, or clusters of objects, augmented with spatial metadata, the downmix presentations require interpretation and interpolation of the spatial metadata used to create 2-channel stereo, 5.1 or 7.1 backward-compatible mixes. These backward compatible mixes are required for legacy Blu-ray players that do not support object-based audio information. Unfortunately, matrix interpolation is not implemented in legacy players and the rate of matrix updates in the implementation described above are limited to only once in a 40-sample interval or integer multiples thereof. Updates of rendering matrix coefficients without interpolation between updates is referred to herein as discontinuous rendering matrix updates. The discontinuous matrix updates that occur at the rates permitted by existing or legacy systems may generate unacceptable artifacts such as zipper noise, clicks and spatial discontinuities.

One potential solution to this problem is to limit the magnitude of the changes in rendering matrix coefficients so that the changes do not generate audible artifacts for critical content. Unfortunately, this solution would limit coefficient changes to be on the order of just a few decibels per second, which is generally too slow for accurate rendering of dynamic content in many motion picture soundtracks.

DISCLOSURE OF INVENTION

It is an object of the present invention to improve the rendering of an object-based presentation using discontinuous rendering matrix updates by eliminating or at least reducing audible artifacts in the presentation. This is achieved by the methods and apparatuses that receive one or more signals conveying object data representing aural content and spatial metadata for each of one or more audio objects, where the spatial metadata contains data representing a location in space relative to a reference position in a playback system; process the object data and configuration information to calculate rendering matrix coefficients for use in rendering signals in the playback system, where the configuration information describes a configuration of acoustic transducers in a set of acoustic transducers for the playback system; calculate a measure of update performance from the calculated rendering matrix coefficients and the object data according to psychoacoustic principles, and derive matrix update parameters from the measure of update performance; generate updated matrix coefficient values in response to the rendering matrix coefficients and the matrix update parameters; update the rendering matrix coefficients in response to the updated matrix coefficient values; and either assemble an encoded representation of the object data and the rendering matrix coefficients into an encoded output signal, or apply the rendering matrix to the object data representing the aural content of audio objects to generate audio output signals representing the aural content of rendered audio objects for respective audio channels.

In one advantageous implementation, the measure of update performance comprises a measure of perceived distortion that would result from updating the rendering matrix with the calculated rendering matrix coefficients; and the matrix update parameters are derived to reduce magnitudes of changes in rendering matrix coefficients in response to the measure of perceived distortion to reduce audibility of artifacts generated by the coefficient changes.

In another advantageous implementation, the matrix update parameters are derived to reduce a rate at which changes in rendering matrix coefficients are performed, where the rate is controlled to reduce audibility of resulting artifacts generated by the coefficient changes. Preferably, the measure of update performance comprises an estimated change in perceived accuracy of spatial characteristics of audio objects rendered by the rendering matrix that would result from updating the rendering matrix with the calculated rendering matrix coefficients; and the rendering matrix coefficients are changed only if the change in perceived accuracy exceeds a threshold.

The features of the present invention and its preferred implementations may be better understood by referring to the following discussion and the accompanying drawings in which like reference numerals refer to like elements in the several figures. The contents of the following discussion and the drawings are set forth as examples only and should not be understood to represent limitations upon the scope of the present invention.

MODES FOR CARRYING OUT THE INVENTION

A. Introduction

1. Encoder/Transmitter

Figure 1:
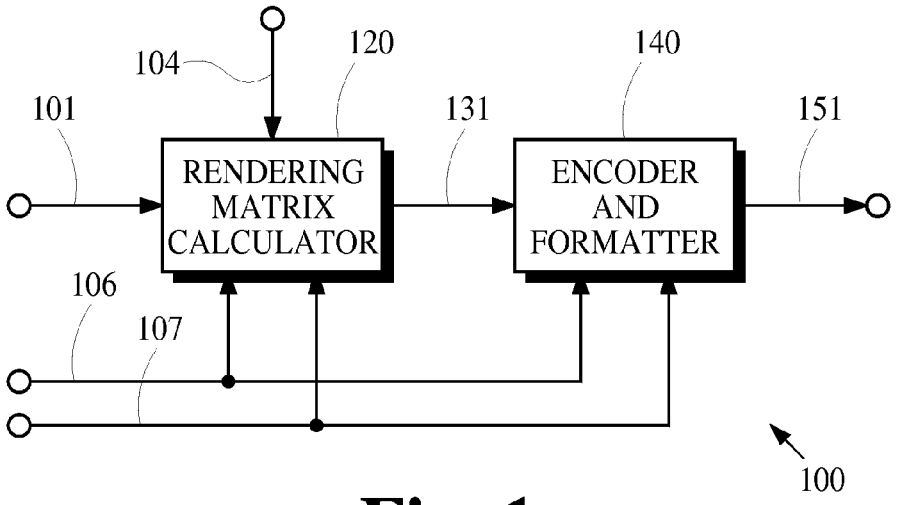
FIG. 1 is a schematic block diagram of an encoder/transmitter that may incorporate various aspects of the present invention.

FIG. 1 is a schematic block diagram of an exemplary implementation of an encoder/transmitter 100 that may be used to encode audio information and transmit the encoded audio information to a companion receiver/decoder playback system 200 or to a device for recording the encoded audio information on a storage medium.

In this exemplary implementation, the rendering matrix calculator 120 receives signals from the path 101 that convey object data and receives signals from the paths 106 and 107 that convey bed channel data. The object data contains audio content and spatial metadata representing the spatial position for each of one or more audio objects. The spatial position describes a location in a single or multidimensional space relative to some reference position. The spatial metadata may also represent other spatial characteristics of the audio objects such as velocity and size of the objects, or information to enable or disable certain acoustic transducers for reproducing the object signal. The bed channel data represents the aural content by means of one or more audio channels, where each audio channel corresponds to an unvarying position relative to the reference position.

Two bed channels are shown in this and other figures for illustrative simplicity. In typical implementations, as many as ten bed channels are used but bed channels are not required to practice the present invention. An implementation of the encoder/transmitter 100 may exclude all operations and components that pertain to the bed channel data and the bed channels.

The rendering matrix calculator 120 processes the object data and the bed channel data to calculate coefficients of a rendering matrix for use in a receiver/decoder playback system 200. The coefficients are calculated also in response to information received from the path 104 that describes the configuration of the acoustic transducers in the receiver/decoder playback system 200. A measure of perceived distortion is calculated from these coefficients, the object data and the bed channel data, and matrix update parameters are derived from this measure of perceived distortion.

The encoder and formatter 140 generates encoded representations of the bed channel data received from the paths 106 and 107 and the object data, rendering matrix coefficients and matrix update parameters received from the path 131, and assembles these encoded representations into an encoded output signal that is passed along the path 151.

The encoded output signal may be transmitted along any desired type of transmission medium or recorded onto any desired type of storage medium for subsequent delivery to one or more receiver/decoder playback systems 200.

2. Receiver/Decoder

Figure 2:
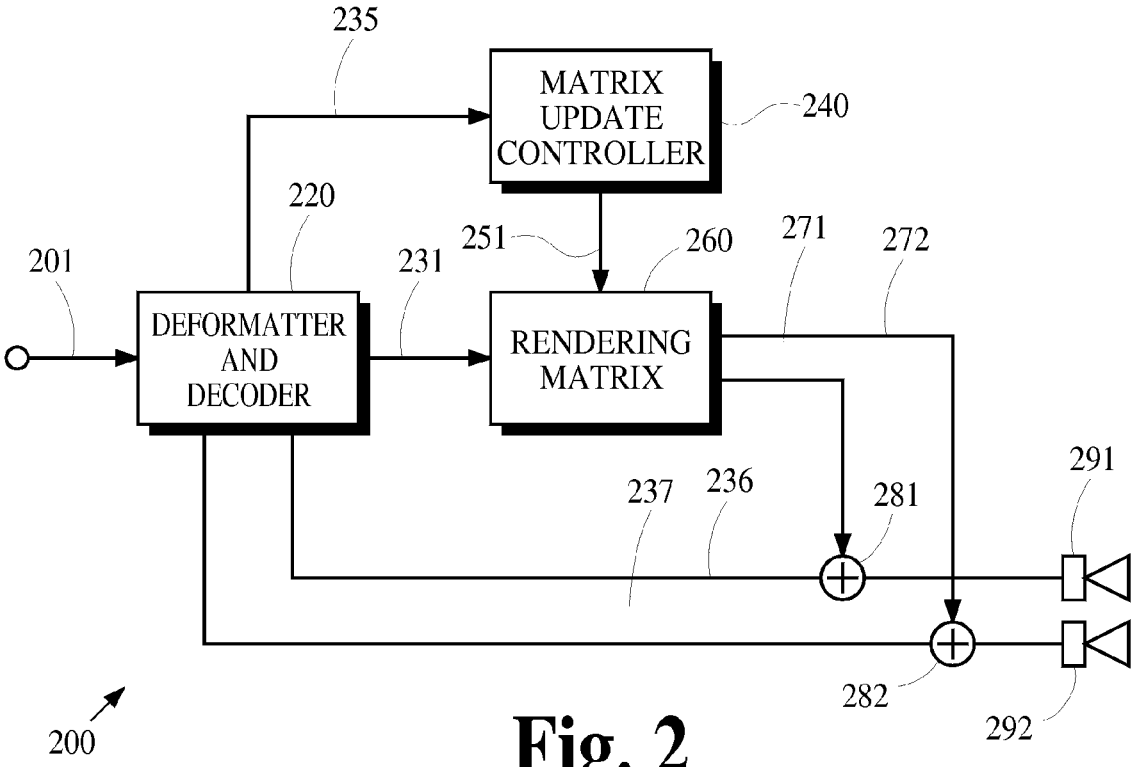
FIG. 2 is a schematic block diagram of a receiver/decoder that may be used in an audio coding system with the encoder/transmitter of FIG. 1.

FIG. 2 is a schematic block diagram of an exemplary implementation of a receiver/decoder playback system 200 that may be used in an audio coding system with the encoder/transmitter 100.

In this implementation, the deformatter and decoder 220 receives an encoded input signal from the path 201. Processes that are inverse to or complementary to the processes used by the encoder and formatter 140 in the encoder/transmitter 100 are applied to the encoded input signal to obtain bed channel data, object data, rendering matrix coefficients and matrix update parameters.

The matrix update controller 240 receives rendering matrix coefficients and matrix update parameters from the path 235 and generates updated coefficient values, which are passed along the path 251.

The rendering matrix 260 receives object data from the path 231 and applies its coefficients to the aural content of the object data to generate channels of intermediate data along the paths 271 and 272. Each channel of intermediate data corresponds to a respective audio channel in the playback system. The values of the rendering matrix coefficients are updated in response to the updated coefficient values received from the path 251.

The values of the rendering matrix coefficients are updated to establish panning gains or relative levels needed for the acoustic transducers to create an aural impression of spatial position in listeners that closely resembles the intended audio object location as specified by its spatial metadata.

The summing node 281 combines the channel of intermediate data from the path 271 with bed channel data from the path 236 and passes the combination along a signal path to drive acoustic transducer 291. The summing node 282 combines the channel of intermediate data from the path 272 with bed channel data from the path 237 to generate output channel data and passes the output channel data along a signal path to drive acoustic transducer 292. In preferred implementations, the functions of the summing nodes 281 and 282 are included in the rendering matrix 260.

Only two intermediate channels and only two output audio channels are shown. The receiver decoder playback system 200 may have more channels as desired. An implementation of the receiver/decoder playback system 200 may exclude any or all of the operations and components that pertain to the bed channel data. Multiple acoustic transducers may be driven by each audio channel.

3. Enhanced Receiver/Decoder

Figure 3:
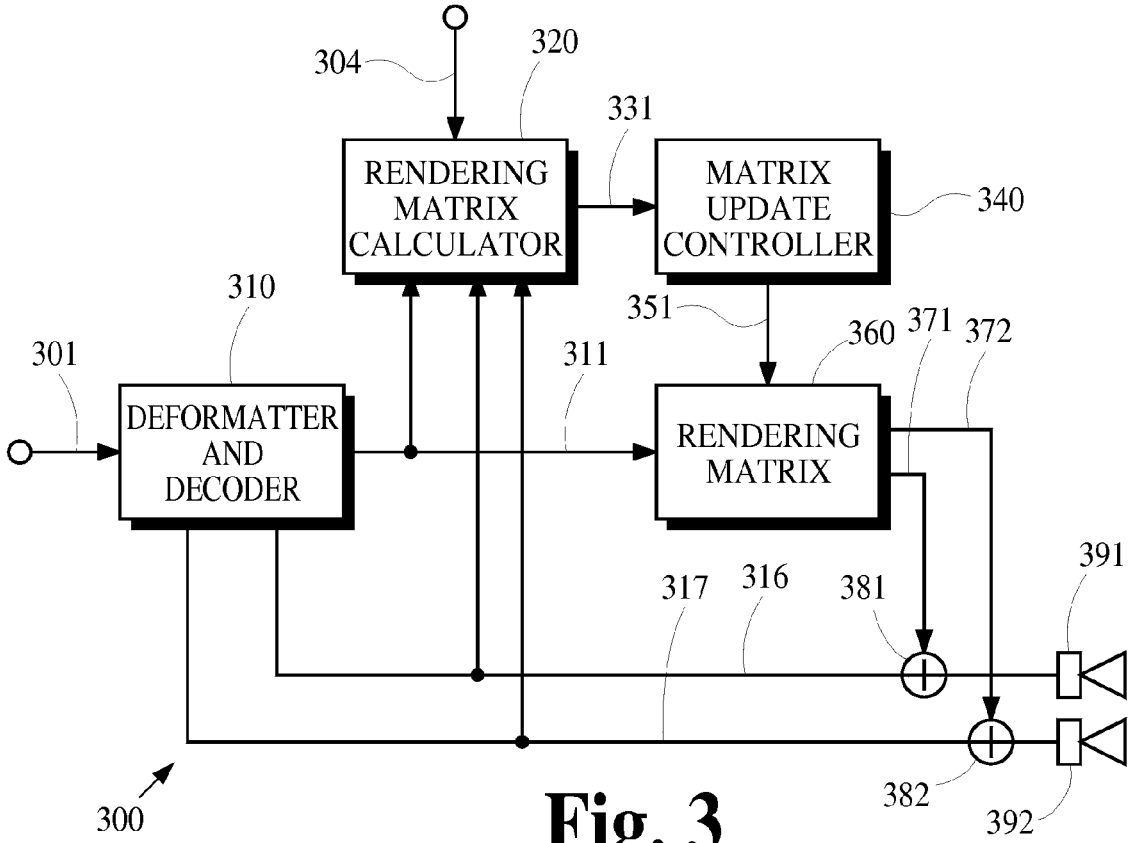
FIG. 3 is a schematic block diagram of a receiver/decoder that may incorporate various aspects of the present invention.

FIG. 3 is a schematic block diagram of an enhanced receiver/decoder playback system 300 that may incorporate various aspects of the invention. The encoder/transmitter used to generate the encoded signal processed by the enhanced receiver/decoder playback system 300 need not incorporate features of the present invention.

In the illustrated implementation, the deformatter and decoder 310 receives an encoded input signal from the path 301. Processes that are inverse to or complementary to the encoding and formatting processes used by the encoder/transmitter that generated the encoded input signal are applied to the encoded input signal to obtain bed channel data that is passed along the paths 316 and 317, and object data and rendering matrix coefficients that are passed along the path 311.

The rendering matrix calculator 320 receives object data and bed channel data from the paths 311, 316 and 317 and processes the object data and the bed channel data to calculate coefficients of the rendering matrix. The coefficients are calculated also in response to information received from the path 304 that describes the configuration of the acoustic transducers in the enhanced receiver/decoder playback system 300. A measure of perceived distortion is calculated from these coefficients, the object data and the channel data, and matrix update parameters are derived from this measure of perceived distortion.

The matrix update controller 340 receives rendering matrix coefficients and matrix update parameters from the path 331 and generates updated coefficient values, which are passed along the path 351.

The rendering matrix 360 receives object data from the path 311 and applies its coefficients to the aural content of the object data to generate channels of intermediate data along the paths 371 and 372. Each channel of intermediate data corresponds to a respective audio channel in the playback system. The values of the rendering matrix coefficients are updated in response to the updated coefficient values received from the path 351.

As described above, the values of the rendering matrix coefficients are updated to establish panning gains or relative levels needed for the acoustic transducers to create an aural impression of spatial position in listeners that closely resembles the intended audio object location as specified by its spatial metadata.

The summing node 381 combines the channel of intermediate data from the path 371 with bed channel data from the path 316 to produce a first output channel and passes the combination along a signal path to drive acoustic transducer 391. The summing node 382 combines the channel of intermediate data from the path 372 with bed channel data from the path 317 to produce a second output channel and passes the combination along a signal path to drive acoustic transducer 392. In preferred implementations, the functions of the summing nodes 381 and 382 are included in the rendering matrix 360.

Only two intermediate channels and two output channels are shown. The playback system 300 may have more channels as desired. An implementation of the receiver/decoder playback system 300 may exclude any or all of the operations and components that pertain to the bed channel data. Multiple acoustic transducers may be driven by each audio channel.

B. Details of Implementation

Details of implementation for components of the systems introduced above are set forth in the following sections.

1. Encoder and Formatter

The encoder and formatter 140 of the encoder/transmitter 100 assembles encoded representations of object data, bed channel data and rendering matrix coefficients into an encoded output signal. This may be done by essentially any encoding and formatting processes that may be desired.

The encoding process may be lossless or lossy, using wideband or split-band techniques in the time domain or the frequency domain. A few examples of encoding processes that may be used include the MLP coding technique mentioned above and a few others that are described in the following papers: Todd et al., "AC-3: Flexible Perceptual Coding for Audio Transmission and Storage, AES 96th Convention, February 1994; Fielder et al., "Introduction to Dolby Digital Plus, an Enhancement to the Dolby Digital Coding System", AES 117th Convention, October 2004; and Bosi et al., "ISO/IEC MPEG-2 Advanced Audio Coding", AES 101st Convention, November 1996.

Any formatting process may be used that meets the requirements of the application in which the present invention is used. One example of a formatting process that is suitable for many applications is multiplexing encoded data and any other control data that may be needed into a serial bit stream.

Neither the encoding nor the formatting process is important in principle to the present invention.

2. Deformatter and Decoder

The deformatter and decoder 220 and the deformatter and decoder 310 receive an encoded signal that was generated by an encoder/transmitter, process the encoded signal to extract encoded object data, encoded bed channel data, and encoded rendering matrix coefficients, and then apply one or more suitable decoding processes to this encoded data to obtain decoded representations of the object data, bed channel data and rendering matrix coefficients.

No particular deformatting or decoding process is important in principle to the present invention; however, in practical systems, they should be inverse to or complementary to the encoding and formatting processes that were used to generate the encoded signal so that the object data, bed channel data, rendering matrix coefficients and any other data that may be important can be recovered properly from the encoded input signal.

3. Rendering Matrix Calculator a) Coefficient Calculator

Figure 4:
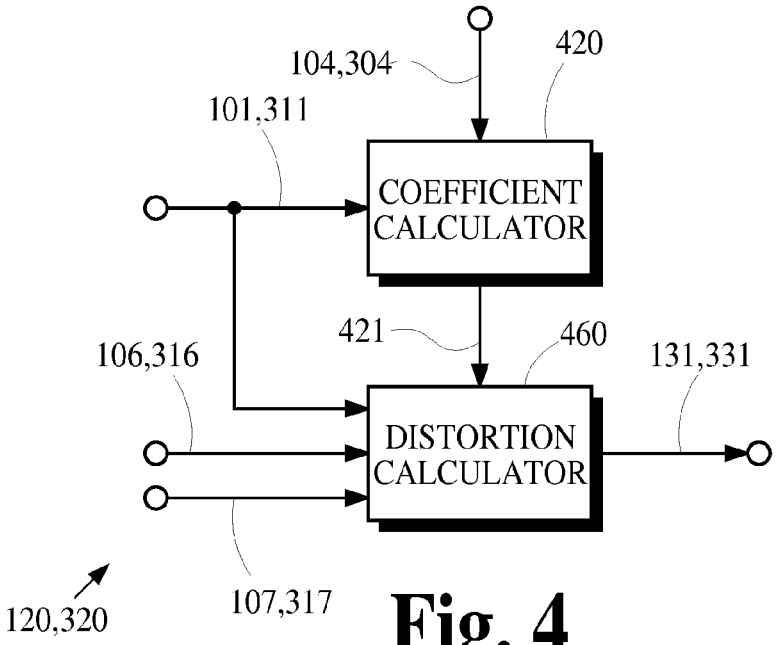
FIG. 4 is a schematic block diagram of an exemplary implementation of a rendering matrix calculator.

FIG. 4 is a schematic block diagram of an exemplary implementation of the rendering matrix calculator 120 and 320. In this implementation, the coefficient calculator 420 receives from the path 101 or 311 spatial metadata obtained from the object data and receives from the path 104 or 304 information that describes the spatial configuration of acoustic transducers in the playback system in which the calculated rendering matrix will be used. Using this information, the coefficient calculator 420 calculates coefficients for the rendering matrix and passes them along the path 421. Essentially any technique may be used that can derive the relative gains or acoustic levels, and optionally changes in phase and spectral content, for two or more acoustic transducers to create phantom acoustic images or listener impressions of an acoustic source at specified positions between the acoustic transducers. A few examples of suitable techniques are described in B. B. Bauer, "Phasor analysis of some stereophonic phenomena," *J. Acoust. Soc. Am.,* 33:1536-1539, November 1961, and J. C. Bennett, K. Barker, and F. O. Edeko, "A new approach to the assessment of stereophonic sound system performance," J. *Audio Eng. Soc.,* 33(5): 314-321, 1985.

The coefficients that are calculated by the rendering matrix calculator 120, 320 or 420 will change as the spatial characteristics of one or more of the audio objects to be rendered changes. We can define three different rendering matrices. The first is the current rendering matrix $M_{curr}$ that is being applied just before the update in the rendering matrix is requested. The second matrix is $M_{new}$, which represents the rendering matrix coefficients resulting from the rendering matrix coefficient calculator 120, 320 or 420. The third rendering matrix is the rendering matrix obtained from the matrix coefficients and matrix update parameters passed along the path 131, or 331 from the distortion calculator 460, referred to as a modified rendering matrix $M_{mod}$. The following matrix arithmetic expression ensures that the modified rendering matrix $M_{mod}$ is equal to the new rendering matrix $M_{new}$:

$$M_{mod}=M_{curr}+(M_{new}-M_{curr}) \quad (1)$$

b) Distortion Calculator

In the implementation shown in FIG. 4, the component 460 calculates a measure of perceived distortion, which is described below. In a more general sense, however, the component 460 calculates a measure of update performance, which is the performance that is achieved by updating or replacing coefficients in the rendering matrix with the calculated rendering matrix coefficients received from the coefficient calculator 420. The following description refers to the implementation that calculates perceived distortion.

The distortion calculator 460 receives from the path 101 or 311 the aural content of the audio objects obtained from the object data and receives bed channel data from the paths 106 and 107 or 316 and 317. In response to this information and the calculated rendering matrix coefficients received from the path 421, the distortion calculator 460 calculates a measure of perceived distortion that is estimated to occur when the audio object data is rendered using the calculated rendering matrix coefficients $M_{new}$. Using this measure of perceived distortion, the distortion calculator 460 generates matrix update parameters that define the amount by which the rendering matrix coefficients can be changed or updated so that perceived distortion is avoided or at least reduced. These matrix update parameters, which define the modified rendering matrix $M_{mod}$, are passed along the path 131 or 331 with the calculated coefficients and the object data. In another implementation, only the changes in matrix coefficients will be passed along the path 131 or 331, represented by the difference between $M_{mod}$ and $M_{curr}$.

In general, the distortion calculator 460 reduces the magnitude of changes in matrix coefficients according to psychoacoustic criteria to reduce the audibility of artifacts created by the changes. One way that this can be done is by controlling the amount of the update by using an update-limit parameter α as follows:

$$M_{mod}=M_{curr}+(M_{new}-M_{curr})\cdot\alpha \text{ for } 0\leq\alpha\leq 1. \tag{2}$$

Alternatively, the update process can use a different update-limit parameter for each rendering matrix coefficient $m_{ij}$, which can be expressed as:

$$m_{i,j,mod}=m_{i,j,curr}+(m_{i,j,new}-m_{i,j,curr})\cdot\alpha_{i,j} \text{ for } 0\leq\alpha_{i,j}\leq 1. \tag{3}$$

The value of an update-limit parameter may be established in response to the aural content of its "associated" audio object, which is that audio object whose aural content is multiplied by the update-limit parameter during the rendering process.

The values of the update-limit parameters α or $\alpha_{i,j}$ are established in response to an estimated perceived distortion that would result if the calculated change in the rendering matrix coefficients is made instantly, which can be expressed as $M_{mod}=M_{new}$.

In one implementation using individual update-limit parameters for each matrix coefficient, the parameters $\alpha_{i,j}$ are set to one when a psychoacoustic model determines its associated audio object is inaudible. An audio object is deemed to be inaudible if the level of its acoustic content is either below the well-known absolute hearing threshold or below the masking threshold of other audio in the object data or the bed channel data.

In another implementation using individual update-limit parameters for each matrix coefficient, each update-limit parameters $\alpha_{i,j}$ is set so that the level of perceived distortion that is calculated by the distortion calculator 460 for the resulting change is just inaudible, which is accomplished if the level of the perceived distortion is either below the absolute hearing threshold or below the masking threshold of audio in the object data or the bed channel data.

An audio object signal for an object with the index j is represented by $x_j[n]$. One of the output channels is denoted here as $y_i[n]$ having the index i. The current rendering matrix coefficient is given by $m_{i,j,curr}$, and the new matrix coefficient generated by the rendering matrix coefficient calculator 120, 320 or 420 is given by $m_{i,j,new}$. Furthermore, the transition from the current rendering matrix to the new rendering matrix is supposed to occur at some sample index n=0. We can then write the contribution of the object j to output channel i as:

$$y_{i,j}[n] = x_j[n]\cdot\left(m+\frac{\delta}{2}u[n]\right) \tag{4}$$

with δ equal to the step size applied in the matrix coefficient, given by:

$$\delta=m_{i,j,curr}+\alpha_{i,j}\cdot(m_{i,j,new}-m_{i,j,curr}) \tag{5}$$

and m equal to the average of the new and current matrix coefficient. The function u[n] represents a step function:

$$u[n] = \begin{cases} -1 & \text{for } n<0 \\ +1 & \text{otherwise} \end{cases} \tag{6}$$

In a frequency-domain representation, the signal $y_i[n]$ can be formulated as:

$$Y_{i,j}[k] = m\cdot X_j[k]+\frac{\delta}{2}X_j[k]*U[k] \tag{7}$$

where * is the convolution operator, and k is the frequency index. This frequency-domain representation can be obtained by calculating a Discrete Fourier Transform of a signal segment centered around n=0. From this expression, it can be observed that the output signal $Y_{i,j}[k]$ comprises a combination of the signal $X_j[k]$ scaled with m, and a distortion term consisting of the convolution of $X_j[k]$ with U[k], which is scaled by $$\frac{\delta}{2}.$$

In one implementation, an auditory masking curve is computed from the signal $m\cdot X_j[k]$ using prior-art masking models. An example of such masking models operating on frequency-domain representations of signals is given in M. van der Heijden and A. Kohlrausch, "Using an excitation-pattern model to predict auditory masking," Hearing Research, 80:38-52, 1994. The level of the distortion term:

$$\frac{\delta}{2}X_j[k]*U[k] \tag{8}$$

can subsequently be altered by determining the value of δ in such a manner that the spectrum of this term is below the masking curve. The modified matrix coefficient is then given by:

$$m_{i,j,mod}=m_{i,j,curr}+\min(\delta,m_{i,j,new}-m_{i,j,curr}) \tag{9}$$

In other implementations, the masking curve may be derived from a sum of all objects that are combined in each output $Y_i[k]$ weighted with the respective rendering matrix coefficients $M_{curr}$:

$$Y_i[k] = \sum_j X_j[k]\cdot m_{i,j,curr} \tag{10}$$

c) Reducing the Update Rate

Depending on application requirements and details of implementation, each update of the rendering matrix can require a significant amount of data, which in turn can impose significant increases on the bandwidth needed to transmit the updated information or on the storage capacity needed to record them. Application requirements may impose limits on available bandwidth or storage capacity that require reducing the rate at which the rendering matrix updates are performed. Preferably, the rate is controlled so that the resulting artifacts generated by the rendering matrix updates are inaudible. This can be achieved by a process that generates a measure of update performance that includes an estimate of the change in perceived accuracy of the spatial characteristics and/or loudness of audio objects as rendered by the calculated new rendering matrix $M_{new}$ as compared to that rendered by the current rendering matrix $M_{curr}$, and updates the rendering matrix only if the estimated change in perceived accuracy exceeds a threshold, limiting the amount of change as described above to avoid generating audible artifacts.

Control of the matrix update rate may be provided by the implementation shown in FIG. 4 by having the component 460 calculate the measure of perceived accuracy as described below for the perceived benefit calculator 440.

Figure 5:
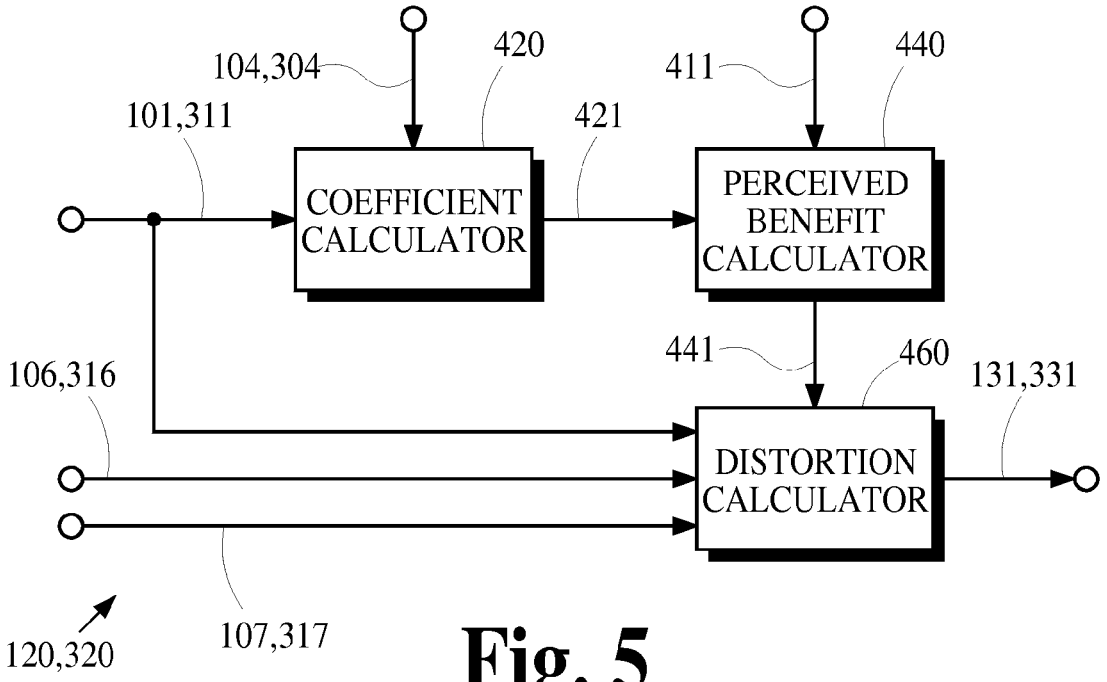
FIG. 5 is a schematic block diagram of another exemplary implementation of a rendering matrix calculator.

Control of the matrix update rate along with the control of update magnitudes described above may be provided by the implementation shown in FIG. 5, which is a schematic block diagram of another exemplary implementation of the rendering matrix calculator 120 and 320. In this implementation, coefficient calculator 420 operates as described above.

The perceived benefit calculator 440 receives from the path 421 the calculated rendering matrix coefficients, which are the new coefficients to be used for updating the rendering matrix. It receives from the path 411 a description of the current rendering matrix $M_{curr}$. In response to the current rendering matrix, the perceived benefit calculator 440 calculates a first measure of accuracy of the spatial characteristics and/or loudness of the audio objects as rendered by $M_{curr}$. In response to the coefficients received from the path 421, the perceived benefit calculator 440 calculates a second measure of accuracy of the spatial characteristics and/or loudness of the audio objects that would be rendered by the rendering matrix if it is updated with the coefficients received from the path 421.

A measure of perceived benefit for updating the rendering matrix is calculated from a difference between the first and second measures of accuracy. The measure of perceived benefit is compared to a threshold. If the measure exceeds the threshold, the distortion calculator 460 is instructed to carry out its operation as explained above.

An example of a perceived benefit is the magnitude of the change in a matrix coefficient. Psychoacoustic research has reported that a rendering matrix must change by approximately 1 dB to give a perceived change in the rendered signals; therefore, changes in the rendering matrix below 1 dB can be discarded without negatively influencing the resulting spatial accuracy in the rendered output signals. Furthermore, if a certain object does not contain an audio signal with a substantial signal level, or is masked by other objects present in the object data, the change in the matrix coefficients associated with that object may not result in an audible change in the overall scene. Matrix updates for silent or masked objects may be omitted to reduce the data rate without audible consequences.

Another example of a perceived benefit is the partial loudness of an audio object in one or more output channels. The partial loudness reflects the perceived loudness of an object including the effect of auditory masking by other objects present in the same output channel. A method to calculate partial loudness of an audio object is given in B. C. J. Moore, B. R. Glasberg, and T. Baer, "A model for the prediction of thresholds, loudness, and partial loudness," *J. Audio Eng. Soc.,* 45 (4): 224-240, April 1997. The partial loudness of an audio object can be calculated for the current rendering matrix $M_{curr}$ as well as for the new rendering matrix $M_{new}$. A matrix update will then be issued only if the partial loudness of an object rendered by these two matrices changes by an amount that exceeds a certain threshold. This threshold may be varied and used to provide a trade-off between the matrix update rate and the quality of the rendering. A lower threshold increases the frequency of updates, resulting in a higher quality of rendering but requiring a higher bandwidth to transmit or a larger storage capacity to record the data representing the updates. A higher threshold has the opposite effect. This threshold is preferably set approximately equal to what is known in the art as the "just-noticeable difference" in partial loudness, which corresponds to a change in signal level of approximately 1 dB.

The distortion calculator 460 operates as described above except that the distortion calculator 460 receives the calculated rendering matrix coefficients from the path 441.

4. Matrix Update Controller

The functions performed by the rendering matrix calculator 120 and the matrix update controller 240 can in principle be divided between the calculator and the controller in a wide variety of ways. If the receiver/decoder playback system 200 was designed to operate in a manner that does not take advantage of the present invention, however, the operation of the matrix update controller 240 will conform to some specification that is independent of the present invention and the rendering matrix calculator 120 should be designed to perform its functions in a way that is compatible with that controller.

The implementations described herein conform to systems that implement the MLP coding techniques mentioned above. In these implementations, the matrix update controller 240 receives rendering matrix coefficients and matrix update parameters from the path 235 and generates updated coefficient values, which are passed along the path 251. The matrix updates do not use interpolation and the rate at which matrix coefficients may be updated is constrained to be no more than once in some integer multiple of an interval spanned by 40 audio samples. If the audio sample rate is 48 kHz, for example, then matrix coefficients cannot be updated more than once in an interval that is an integer multiple of about 83 msec. The matrix update parameters received from the path 235 specify when the rendering matrix coefficients may be updated and the matrix update controller 240 operates generally as a slave unit, generating updated coefficient values according to those parameters.

The functions performed by the rendering matrix calculator 320 and the matrix update controller 340 in the enhanced receiver/decoder playback system 300 may be divided between the calculator and the controller in essentially any way that may be desired. Their functions can be integrated into a single component. The exemplary implementation shown in FIG. 3 and described herein has a separate calculator and controller merely for the sake of conforming to the implementations described for the encoder/transmitter 100 and the receiver/decoder playback system 200 shown in FIGS. 1 and 2. In this implementation, the matrix update controller 340 operates as a slave unit, generating updated coefficient values according to the matrix update parameters received from the path 331 and passes the updated coefficient values along the path 351.

5. Rendering Matrix

The rendering matrix 260 and 360 may be performed by any numeric technique that implements matrix multiplication with a matrix whose coefficient values change in time. The input to the matrix multiplication is a vector of elements representing the aural content for respective audio objects to render, which is obtained from the object data. The output from the matrix multiplication is a vector of elements representing the aural content of all rendered audio objects to be included in respective audio channels of the playback system.

In one implementation, the matrix has a number of columns equal to the number of audio objects to be rendered and has a number of rows equal to the number of audio output channels in the playback system. This implementation requires adapting the number of columns as the number of audio objects to render changes. In another implementation, the number of columns is set equal to a fixed value equal to the maximum number of audio objects that can be rendered by the system. In yet another implementation, the number of columns varies as the number of audio objects to render changes but is constrained to be no smaller than some "floor" value. Equivalent implementations are possible using a transpose of the matrix with the numbers of columns and rows interchanged.

The values of the coefficients in the rendering matrix 260 are updated in response to the updated coefficient values generated by the matrix update controller 240 and passed along the path 251. The values of the coefficients in the rendering matrix 360 are updated in response to the updated coefficient values generated by the matrix update controller 340 and passed along the path 351.

The exemplary implementations shown in FIGS. 2 and 3 contain summing nodes 281, 282, 381 and 382 that are used to combine outputs from the rendering matrix with bed channel data. Preferably, the operation of these summing nodes is included in the rendering matrix operation itself so that peak limiting functions can be implemented within the matrix.

Whenever digital signals represented by fixed-length integers are mixed together, the resulting mix can generate clipping or other non-linear artifacts if the result of any arithmetic calculation overflows or exceeds the range that can be expressed by the fixed-length integers.

There are at least three ways this problem can be avoided. Two of the ways increase the signal "headroom" either by decreasing the overall level of the digital signals or by increasing the length of the integer representations so that arithmetic calculations cannot overflow. The third way modifies selected digital signal samples, attenuating those samples that would cause arithmetic overflow just prior to performing the calculations that would otherwise overflow, and then reversing the attenuation after the calculations are completed.

This third way is sometimes referred to as "peak limiting." Preferably, peak limiting applies a smoothly changing level of attenuation to those signal samples that surround a peak signal level, starting the attenuation perhaps 1 msec before a peak and returning to unity gain across an interval of perhaps 5 to 1000 msec after the peak.

Peak limiting can be integrated into the discontinuous matrix update process by including an additional gain factor $g_i$ with each of the update matrix coefficients as follows:

$$m_{i,j,mod}=m_{i,j,curr}+(g_i\cdot m_{i,j,new}-m_{i,j,curr})\cdot\alpha_{i,j} \text{ for } 0\leq\alpha_{i,j}\leq 1. \quad (11)$$

Each of the factors $g_i$ in the matrix $M_{new}$ is adjusted so that the rendered audio output signal $y_i(t)$ does not overflow, where:

$$y_i(t)=\sum_j m_{i,j,mod}\cdot x_j(t); \quad (12)$$

$x_j(t)$=audio content of audio object j; and $y_i(t)$=output audio signal for output channel i.

C. Implementation

Figure 6:
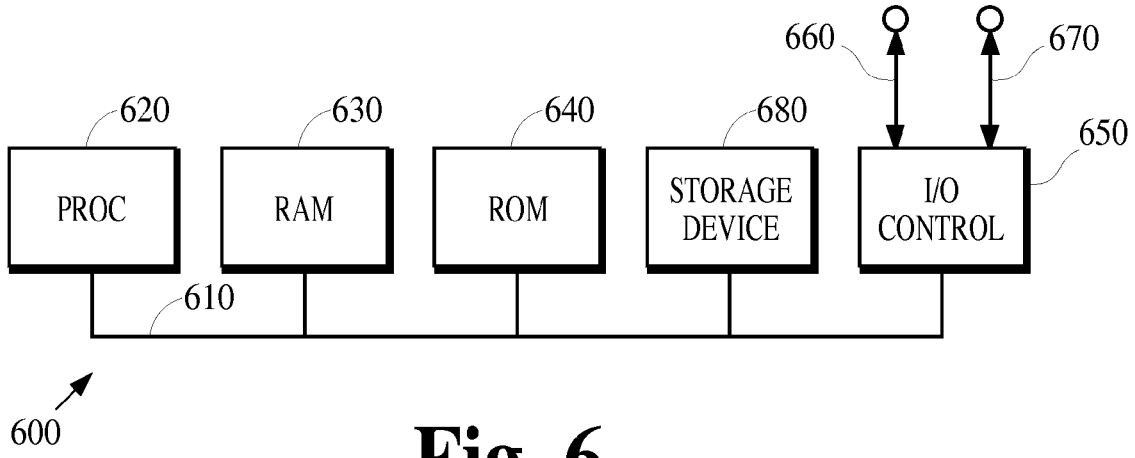
FIG. 6 is a schematic block diagram of a device that may be used to implement various aspects of the present invention.

Devices that incorporate various aspects of the present invention may be implemented in a variety of ways including software for execution by a computer or some other device that includes more specialized components such as digital signal processor (DSP) circuitry coupled to components similar to those found in a general-purpose computer. FIG. 6 is a schematic block diagram of a device 600 that may be used to implement aspects of the present invention. The processor 620 provides computing resources. RAM 630 is system random access memory (RAM) used by the processor 620 for processing. ROM 640 represents some form of persistent storage such as read only memory (ROM) for storing programs needed to operate the device 600 and possibly for carrying out various aspects of the present invention. I/O control 650 represents interface circuitry to receive and transmit signals by way of the communication channels 660, 670. In the embodiment shown, all major system components connect to the bus 610, which may represent more than one physical or logical bus; however, a bus architecture is not required to implement the present invention.

In embodiments implemented by a general purpose computer system, additional components may be included for interfacing to devices such as a keyboard or mouse and a display, and for controlling a storage device 680 having a storage medium such as magnetic tape or disk, or an optical medium. The storage medium may be used to record programs of instructions for operating systems, utilities and applications, and may include programs that implement various aspects of the present invention.

The functions required to practice various aspects of the present invention can be performed by components that are implemented in a wide variety of ways including discrete logic components, integrated circuits, one or more ASICs and/or program-controlled processors. The manner in which these components are implemented is not important to the present invention.

Software implementations of the present invention may be conveyed by a variety of machine readable media such as baseband or modulated communication paths throughout the spectrum including from supersonic to ultraviolet frequencies, or storage media that records information using essentially any recording technology including magnetic tape, cards or disk, optical cards or disc, and detectable markings on media including paper.

The invention claimed is:

1. A method for processing audio information that includes object data, wherein the method comprises:

receiving one or more signals that convey the object data representing aural content and spatial metadata for each of one or more audio objects, wherein the spatial metadata contains data representing a location in space relative to a reference position in a playback system;

processing the object data and configuration information to calculate rendering matrix coefficients for use in rendering signals in the playback system, wherein the configuration information describes a configuration of acoustic transducers in a set of acoustic transducers for the playback system;

calculating a measure of update performance from the calculated rendering matrix coefficients and the object data according to psychoacoustic principles relating to the audibility of artifacts created by changes to rendering matrix coefficients, and deriving matrix update parameters from the measure of update performance;

generating updated matrix coefficient values in response to the rendering matrix coefficients and the matrix update parameters;

updating the rendering matrix coefficients in response to the updated matrix coefficient values; and either assembling an encoded representation of the object data and the rendering matrix coefficients into an encoded output signal, or applying the rendering matrix to the object data representing the aural content of audio objects to generate audio output signals representing the aural content of rendered audio objects for respective audio channels.

2. The method of claim 1, wherein:

the measure of update performance comprises a measure of perceived distortion that would result from updating the rendering matrix with the calculated rendering matrix coefficients; and the matrix update parameters are derived to reduce magnitudes of changes in rendering matrix coefficients in response to the measure of perceived distortion to reduce audibility of artifacts generated by the coefficient changes.

3. The method of claim 2 that comprises:

receiving one or more signals that convey bed channel data representing aural content for each of one or more audio channels, wherein each audio channel corresponds to an unvarying position relative to the reference position;

wherein:

the measure of perceived distortion is calculated also from the bed channel data; and either an encoded representation of the bed channel data is assembled into the encoded output signal, or the applying of the rendering matrix also includes combining with bed channel data to generate audio output signals representing the combined aural content of bed channel data and rendered audio objects for respective audio channels.

4. The method of claim 2, wherein magnitudes of changes in rendering matrix coefficients are controlled by one or more update-limit parameters established in response to an estimated perceived distortion resulting from the changes in rendering matrix coefficients.

5. The method of claim 4, wherein the one or more update-limit parameters are set not to reduce magnitudes of changes in rendering matrix coefficients when a psychoacoustic model determines its associated audio object is inaudible.

6. The method of claim 1 that comprises deriving the matrix update parameters to reduce a rate at which changes in rendering matrix coefficients are performed, wherein the rate is controlled to reduce audibility of resulting artifacts generated by the coefficient changes.

7. The method of claim 6, wherein:

the measure of update performance comprises an estimated change in perceived accuracy of spatial characteristics of audio objects rendered by the rendering matrix that would result from updating the rendering matrix with the calculated rendering matrix coefficients; and performing the changes in rendering matrix coefficients only if the change in perceived accuracy exceeds a threshold.

8. The method of claim 1, wherein each coefficient in the rendering matrix has an associated gain factor, and wherein the method comprises:

adjusting each gain factor so that output of the rendering matrix does not exceed a maximum allowable level.

9. The method of claim 1 that comprises driving one or more acoustic transducers in the set of acoustic transducers in response to each audio output signal.

10. An audio information processing apparatus for processing audio information that includes object data, wherein the audio information processing apparatus comprises one or more processors configured to:

receive one or more signals that convey the object data representing aural content and spatial metadata for each of one or more audio objects, wherein the spatial metadata contains data representing a location in space relative to a reference position in a playback system;

process the object data and configuration information to calculate rendering matrix coefficients for use in rendering signals in the playback system, wherein the configuration information describes a configuration of acoustic transducers in a set of acoustic transducers for the playback system;

calculate a measure of update performance from the calculated rendering matrix coefficients and the object data according to psychoacoustic principles relating to the audibility of artifacts created by changes to rendering matrix coefficients, and deriving matrix update parameters from the measure of update performance;

generate updated matrix coefficient values in response to the rendering matrix coefficients and the matrix update parameters;

update the rendering matrix coefficients in response to the updated matrix coefficient values; and either assemble an encoded representation of the object data and the rendering matrix coefficients into an encoded output signal, or apply the rendering matrix to the object data representing the aural content of audio objects to generate audio output signals representing the aural content of rendered audio objects for respective audio channels.

11. The audio information processing apparatus of claim 10, wherein:

the measure of update performance comprises a measure of perceived distortion that would result from updating the rendering matrix with the calculated rendering matrix coefficients; and the matrix update parameters are derived to reduce magnitudes of changes in rendering matrix coefficients in response to the measure of perceived distortion to reduce audibility of artifacts generated by the coefficient changes.

12. The audio information processing apparatus of claim 11, wherein the one or more processors are further configured to receive one or more signals that convey bed channel data representing aural content for each of one or more audio channels, wherein each audio channel corresponds to an unvarying position relative to the reference position;

wherein:

the measure of perceived distortion is calculated also from the bed channel data; and either an encoded representation of the bed channel data is assembled into the encoded output signal, or the applying of the rendering matrix also includes combining with bed channel data to generate audio output signals representing the combined aural content of bed channel data and rendered audio objects for respective audio channels.

13. The audio information processing apparatus of claim 11, wherein magnitudes of changes in rendering matrix coefficients are controlled by one or more update-limit parameters established in response to an estimated perceived distortion resulting from the changes in rendering matrix coefficients.

14. The audio information processing apparatus of claim 13, wherein the one or more update-limit parameters are set not to reduce magnitudes of changes in rendering matrix coefficients when a psychoacoustic model determines its associated audio object is inaudible.

15. The audio information processing apparatus of claim 10, wherein the audio information process is further configured to derive the matrix update parameters to reduce a rate at which changes in rendering matrix coefficients are performed, wherein the rate is controlled to reduce audibility of resulting artifacts generated by the coefficient changes.

16. The audio information processing apparatus of claim 15, wherein:

the measure of update performance comprises an estimated change in perceived accuracy of spatial characteristics of audio objects rendered by the rendering matrix that would result from updating the rendering matrix with the calculated rendering matrix coefficients; and the one or more processors are configured to perform the changes in rendering matrix coefficients only if the change in perceived accuracy exceeds a threshold.

17. The audio information processing apparatus of claim 10, wherein each coefficient in the rendering matrix has an associated gain factor, and wherein the one or more processors are further configured to adjust each gain factor so that output of the rendering matrix does not exceed a maximum allowable level.

18. The audio information processing apparatus of claim 10, wherein the audio information processing apparatus is further configured to drive one or more acoustic transducers in the set of acoustic transducers in response to each audio output signal.

19. A non-transitory medium recording a program of instructions that is executable by a device to perform a method for processing audio information that includes object data, wherein the method comprises:

receiving one or more signals that convey the object data representing aural content and spatial metadata for each of one or more audio objects, wherein the spatial metadata contains data representing a location in space relative to a reference position in a playback system;

processing the object data and configuration information to calculate rendering matrix coefficients for use in rendering signals in the playback system, wherein the configuration information describes a configuration of acoustic transducers in a set of acoustic transducers for the playback system;

calculating a measure of update performance from the calculated rendering matrix coefficients and the object data according to psychoacoustic principles relating to the audibility of artifacts created by changes to rendering matrix coefficients, and deriving matrix update parameters from the measure of update performance;

generating updated matrix coefficient values in response to the rendering matrix coefficients and the matrix update parameters;

updating the rendering matrix coefficients in response to the updated matrix coefficient values; and either assembling an encoded representation of the object data and the rendering matrix coefficients into an encoded output signal, or applying the rendering matrix to the object data representing the aural content of audio objects to generate audio output signals representing the aural content of rendered audio objects for respective audio channels.

20. The medium of claim 19, wherein:

the measure of update performance comprises a measure of perceived distortion that would result from updating the rendering matrix with the calculated rendering matrix coefficients; and the matrix update parameters are derived to reduce magnitudes of changes in rendering matrix coefficients in response to the measure of perceived distortion to reduce audibility of artifacts generated by the coefficient changes.

* * * * *